US008657466B2

(12) United States Patent
Bosch et al.

(10) Patent No.: US 8,657,466 B2
(45) Date of Patent: Feb. 25, 2014

(54) STREET LIGHTING DEVICE

(75) Inventors: Frank Bosch, Lippstadt (DE); Michael Domroese, Lippstadt (DE); Werner Guderjan, Lippstadt (DE); Dieter Jestel, Castrop-Rauxel (DE); Hendrik Kleinemeier, Rietbeg (DE); Alexander Kornek, Aalen (DE); Martin-John Kortmoller, Munster (DE); Waldemar Kurkofka, Rheda-Wiedenbruck (DE); Alfons Puls, Soest (DE); Achim Schulte, Arnsberg (DE); Jeannette Schulte, Salzkotten (DE); Christian Smarslik, Lippstadt (DE); Lukas Wahmes, Lippstadt (DE)

(73) Assignee: Hella KGAA Hueck & Co., Lippstadt (DE)

( * ) Notice: Subject to any disclaimer, the term of this patent is extended or adjusted under 35 U.S.C. 154(b) by 0 days.

(21) Appl. No.: 13/294,738

(22) Filed: Nov. 11, 2011

(65) Prior Publication Data

US 2012/0236560 A1 Sep. 20, 2012

Related U.S. Application Data

(63) Continuation of application No. PCT/EP2010/056337, filed on May 10, 2010.

(51) Int. Cl.
*F21V 1/00* (2006.01)

(52) U.S. Cl.
USPC ..... 362/237; 362/240

(58) Field of Classification Search
USPC ..... 362/431, 237–240, 249.01, 249.02, 362/236, 242
See application file for complete search history.

(56) References Cited

U.S. PATENT DOCUMENTS

| | | | | |
|---|---|---|---|---|
| 6,784,357 | B1 * | 8/2004 | Wang | 136/244 |
| 2007/0201225 | A1 * | 8/2007 | Holder et al. | 362/227 |
| 2008/0285273 | A1 * | 11/2008 | Liu et al. | 362/240 |
| 2010/0135036 | A1 * | 6/2010 | Matsuba et al. | 362/516 |
| 2010/0195330 | A1 * | 8/2010 | Schaefer et al. | 362/237 |
| 2012/0039077 | A1 * | 2/2012 | Householder | 362/308 |

FOREIGN PATENT DOCUMENTS

| | | | |
|---|---|---|---|
| CN | 1839176 | A | 9/2006 |
| EP | 1906081 | A1 | 4/2008 |
| EP | 1916468 | A1 | 4/2008 |
| EP | 1988576 | A1 | 11/2008 |
| EP | 2039985 | A2 | 3/2009 |

* cited by examiner

*Primary Examiner* — Julie Shallenberger
(74) *Attorney, Agent, or Firm* — Yakov Sidorin; Quarles & Brady LLP

(57) ABSTRACT

An illumination device comprising a housing positionable at a distance from an area to be illuminated and having at least one lighting module, on a support in the housing, that has lighting units having the same light distribution characteristics. Each of the lighting units contains lighting elements and associated lenses arranged in front of the same in the light-emitting direction. Different lighting modules may include lighting units having different light distribution characteristics, while the lighting units have optical axes running parallel to each other. At least one lighting unit is configured such that its light distribution characteristics have at least one asymmetrical section relative to a central plane of the lighting unit.

10 Claims, 13 Drawing Sheets

STREET LIGHTING DEVICE

PRIORITY CLAIM

This application is a continuation of pending International Application No. PCT/EP2010/056337 filed on May 10, 2010, which designates the United States and claims priority from German Patent Application No. 10 2009 021 208 filed on May 13, 2011.

BACKGROUND OF THE INVENTION

1. Field of the Invention

The invention relates to a lighting device for streets, pathways and the like. Without admitting to be prior art, such light devices include a housing positioned at a distance from a surface that is to be illuminated. At least one lighting module is mounted on a support in the housing and may include a number of lamp units of equal light distribution characteristics. Each of the lamp units may have multiple light sources and lenses, which may be individually assigned to and positioned in front of these light sources in the direction of the light emission for generating a predefined light distribution pattern. The light device may include different lighting modules which are at least equipped with lamp units displaying a different light distribution characteristic.

2. Description of Relevant Art

EP 1 916 468 A1 describes a lighting device for streets, pathways and the like, with a housing containing multiple lighting modules for generating a predefined light distribution. The housing of the lighting device is mounted on a curbside pole, allowing a longitudinal section of the street to be illuminated as the object surface. The lighting modules mounted in the housing are of an elongated design and are provided with a support on which lamp units of an identical type of light distribution characteristic are installed in rows. Each lamp unit essentially consists of an LED light source and, positioned in front of it in the direction of the light emission, a lens. The lamp units of the lighting module are shielded by a common, transparent cover plate.

For generating a predefined light distribution of the lighting device, several lighting modules with different types of light sources and/or different light distribution characteristics are employed. A first lighting module includes lamp units with first lenses which in relation to a central plane emit a relatively narrow light cone. A second lighting module includes lamp units with second lenses which in relation to the central axis emit a relatively broad light cone. Third lighting modules include lamp units with third lenses which emit light cones in a dihedral range located between the light cone of the first lamp unit and the second lamp unit. The lighting modules with the lamp units that emit in the dihedral range a relatively narrow light cone are so positioned in the housing that they illuminate a marginal area of the surface to be illuminated. A main area of the surface to be illuminated is illuminated by the lighting modules with the broad-beam lamp units. In relation to the central axis the light cones of the different lighting modules or lamp units are symmetrical. It follows that the lighting device for homogeneously illuminating the street section is relatively complex and expensive. Another drawback is the fact that several differently configured lenses must be used.

SUMMARY OF THE INVENTION

It is an object of the invention to improve the design of a lighting device in a manner whereby, in simple fashion and as needed, a predefined light distribution is achieved for an homogeneous illumination of an area.

In an embodiment a lighting device for streets, pathways and the like is provided. The lighting device has a housing that may be positioned at a distance from a surface area to be illuminated. Said housing includes a support board and on the support board at least one lighting module with multiple lamp units of an identical light distribution characteristic, each containing multiple light sources. A lens may be mounted in front of each light source for generating a predefined light distribution, with different lighting modules comprising at least lamp units of a different light distribution characteristic. Lamp units of the same light distribution characteristic have optical axes that extend parallel to each other and at least of one lamp units is configured such that the light distribution characteristic generated by it includes at least one section that is asymmetric relative to a central plane of the lamp unit The particular advantage of the lighting device consists in the fact that combining lamp units having an asymmetric light emission characteristic is an effective way to generate a predefined light distribution and especially a relatively homogeneous light distribution. Because the optical axes of the lamp units of identical or different types, meaning lamp units having the same or a different light distribution characteristic, extend parallel to one another, it is possible to position the lamp units or lighting modules in easy-to-install fashion in a predetermined identical or different plane.

The lighting device permits a modular design and at the same time to retrofit already existing, installed lighting devices for streets, pathways and the like. A three-dimensional configuration of the lighting modules is not necessary.

In a preferred embodiment the lamp units are provided with asymmetrically configured lenses so that on a first side, in relation to a central plane, a first partial light beam is emitted in a first dihedral range and on the opposite second side a second partial light beam is emitted in a second dihedral range different from the first dihedral range. The light distribution characteristic of the lamp units thus includes an asymmetric section, where the first dihedral range may for instance be larger than the second dihedral range. The first dihedral range can thus define a preferred direction or a preferred dihedral angle in which the flux and/or the light intensity is bigger than in the second dihedral range.

In further embodiment the lamp units of the same type and/or of different types are provided with identical lenses. To create a differently oriented asymmetric section of the light distribution characteristic of the lighting module in relation to the orientation of the lighting module, the lenses are rotated in a perpendicular relation to a support of the lighting module. The reference axis is offset in a coaxial or parallel position relative to the optical axis of the lamp units. Thus, merely rotating the lenses permits the generation of a different light distribution characteristic. By modular superpositioning of the light distribution characteristics or of the lighting modules the specified light distribution can be generated.

In another embodiment, the lamp units are mounted in rows on a common support, forming an elongated lighting module. The lighting module thus advantageously matches the dimension of conventional lighting systems which can therefore be easily retrofitted.

In another embodiment the lighting modules can be arranged in relation to one another in a linear and/or frame-shaped and/or square, star- or propeller- or cross-shaped pattern so that, as a function of the available or desired dimensions of the lighting device the predefined light distribution is attainable. The needed light distribution can be adjusted by selecting lighting modules of different types.

In another embodiment the elongated lighting modules of the same and/or different type are combined in a way as to produce an asymmetric light pattern for illuminating a relatively narrow street, with the lighting device placed in a curbside position. The orientation of the lighting modules or lamp units is so chosen that the lighting modules point in the same preferred direction. Advantageously, this permits homogeneous illumination of a predefined longitudinal section of the street.

In another embodiment the lighting modules are configured for illuminating a street from above the median and are arranged in a way as to ensure symmetrical illumination of both sides of the median in the predefined longitudinal section of the street. To that effect, a first half of the lighting modules points in a first preferred direction and a second half of the lighting modules points in a preferred direction opposite the former.

In another embodiment the lighting modules are configured for illuminating a place from a central point above the latter are so positioned that the asymmetric light distribution characteristics of the lighting modules point in four different directions, whereby, in relation to a circumferential central axis, lighting modules mutually juxtaposed at a 90° angle point in the respective preferred directions. Advantageously, this essentially permits a rotationally symmetric illumination of a street.

In another embodiment the lighting modules are configured for illuminating a street corner and are so arranged as to produce two partial light beams which, at a right angle to each other, point in the respective preferred directions. This permits the homogeneous illumination of a junction or a corner area at an intersection.

In a further embodiment the light sources include LED chips and the frame of the lighting module supporting the LED chips and the lens is shielded with a transparent cover plate. The lighting modules are thus always of the same design, while in relation to its axis of symmetry only the lens may be turned in different positions. Advantageously the lighting module is thus of a relatively simple design.

BRIEF DESCRIPTION OF THE DRAWINGS

The following describes exemplified embodiments in more detail with the aid of the drawings in which.

DETAILED DESCRIPTION OF THE PREFERRED EMBODIMENTS

In the following, the invention will be described by way of example, without limitation of the general inventive concept, on examples of embodiments and with reference to the drawings.

Figure 1:
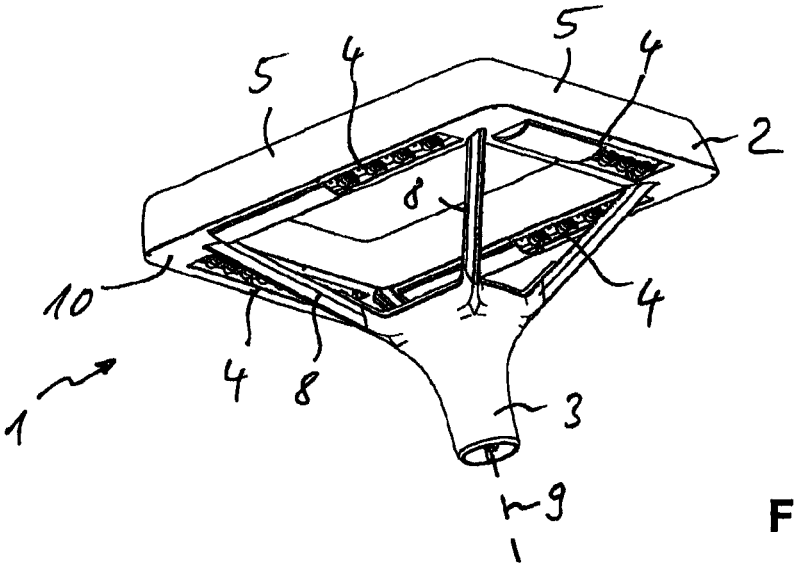
FIG. 1 is a perspective bottom view of a lighting device with lighting modules in a frame-shaped arrangement.
Figure 2:
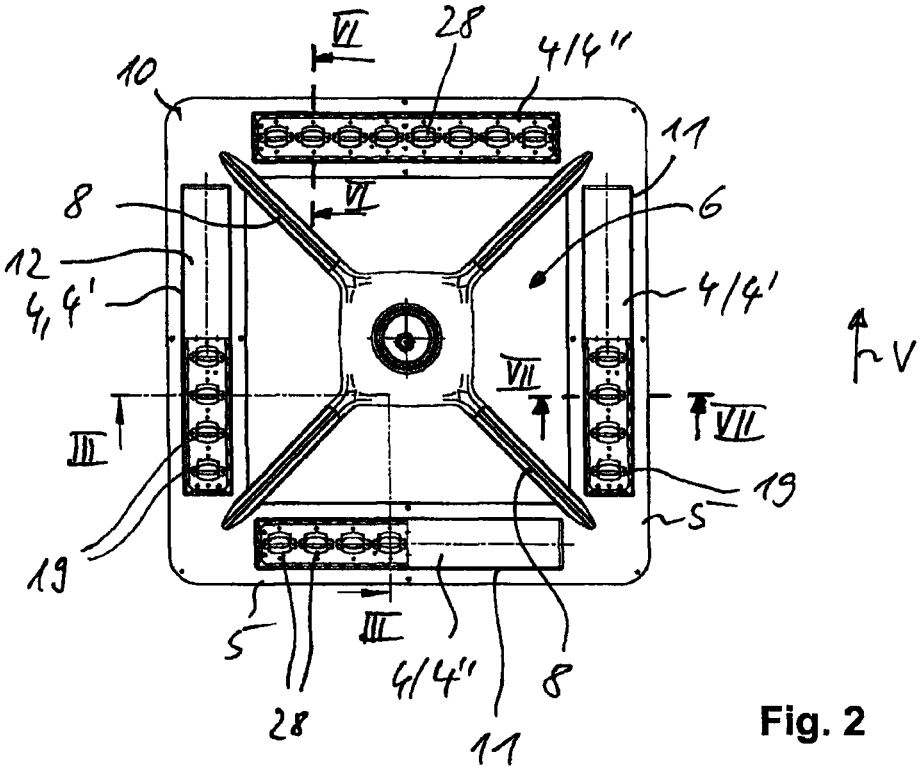
FIG. 2 is a bottom view of the lighting device per FIG. 1.
Figure 3:
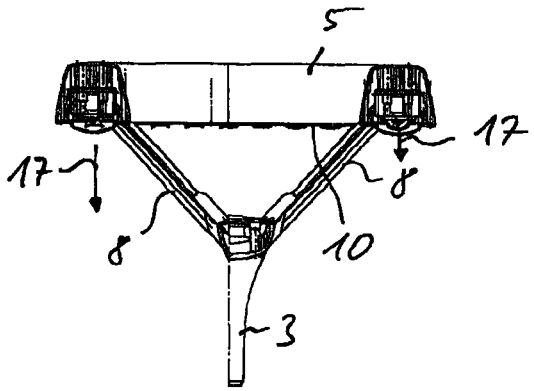
FIG. 3 is a sectional view of the lighting device per FIG. 2 along line III-III in FIG. 2.

FIGS. 1 to 3 depict a first embodiment of a lighting device 1 for streets, pathways and the like. It includes a frame-shaped housing 2 mounted on a pole, not illustrated, via a base 3. The housing 2 is thus positioned at a predefined distance from the area to be illuminated (street, pathway etc.). In combination with its base 3 the lighting device 1 is mushroom-shaped.

The lighting device 1 is of a segmented design, comprising multiple straight-linear lighting modules 4, each positioned on a frame side 5 of the lighting device 1. The frame sides 5 of the lighting device 1 delimit a square opening 6. From corners of this frame-shaped housing 2 extend brackets 8 at an angle of about 45° relative to the pole axis or axis of symmetry 9 of the lighting device 1. On its bottom side 10 the frame-shaped housing 2 has four recesses 11, each associated with a frame side 5. Each recess 11 accommodates a lighting module 4 and is shielded by a transparent cover plate 12.

As can be seen especially in FIG. 2*a* lighting module 4' exhibiting a first light distribution characteristic (of a first type) is arranged at each of, the mutually opposite frame sides 5 of housing 2 while a lighting module 4" having a second light distribution (of a second type) is arranged at each of two other mutually opposite frame sides 5. The following will describe the configuration of lighting modules 4, 4', 4" in more detail with reference to FIGS. 4 to 7.

Figure 4:
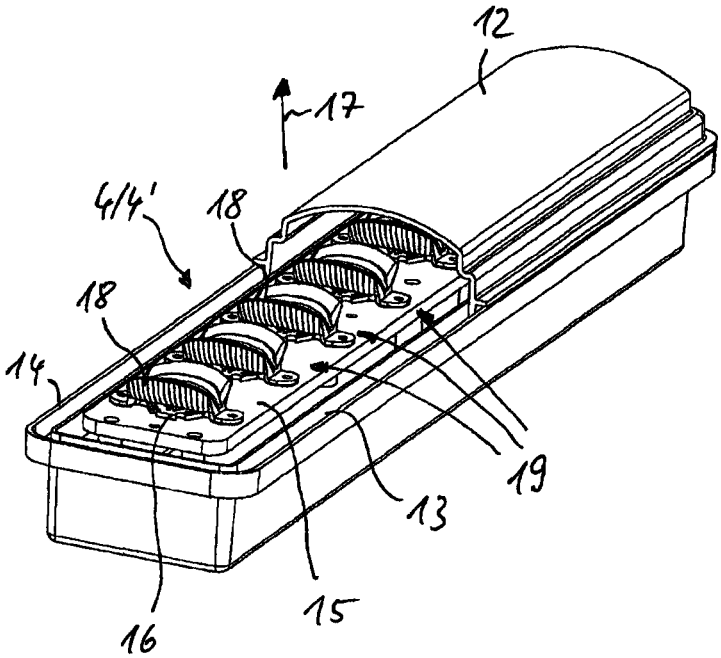
FIG. 4 is a perspective view of the lighting module with a partly cut-out cover plate.
Figure 5:
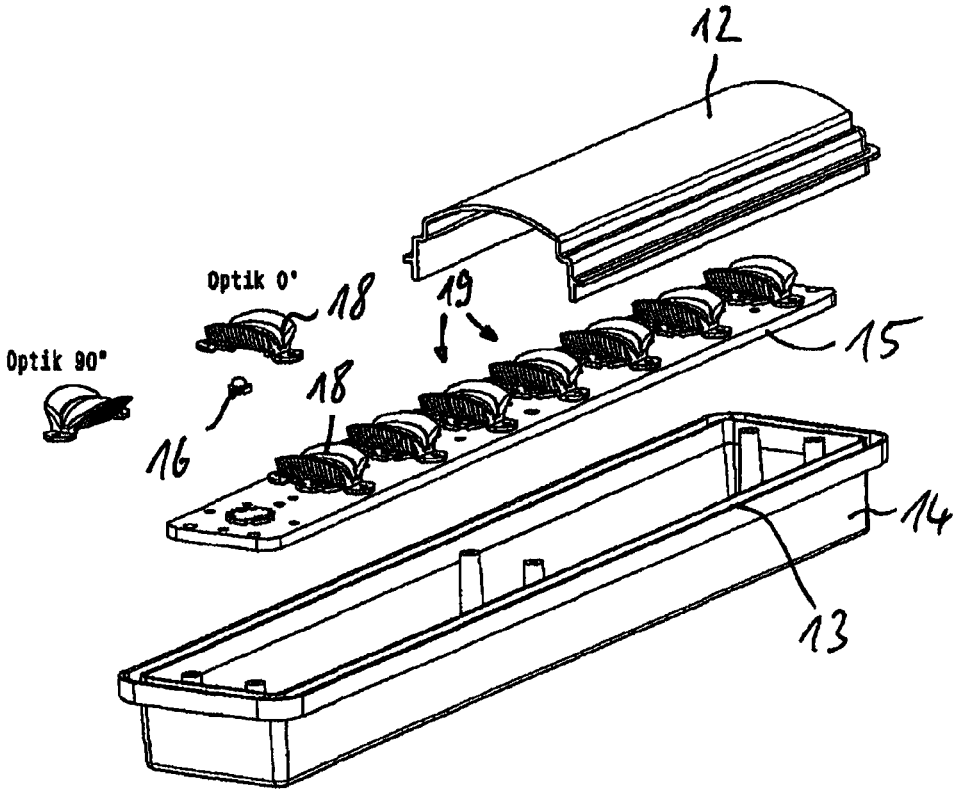
FIG. 5 is an exploded view of the lighting module.

FIGS. 4 and 5 illustrate a lighting module 4' of the first type. A support (support board 15) is mountable on the outer rim 13 of a tub-shaped lower casing 14 is. The support board 15 is in the form of an elongated, i.e. linear circuit board with eight light sources (LED light sources, LED chips 16) surface-mounted in a row and each covered in the main emission direction 17 by a conchiform lens 18. Each LED chip 16 with an associated lens 18 constitutes a lamp unit 19 of a first type which emits light with a first light distribution characteristic.

Figure 6:
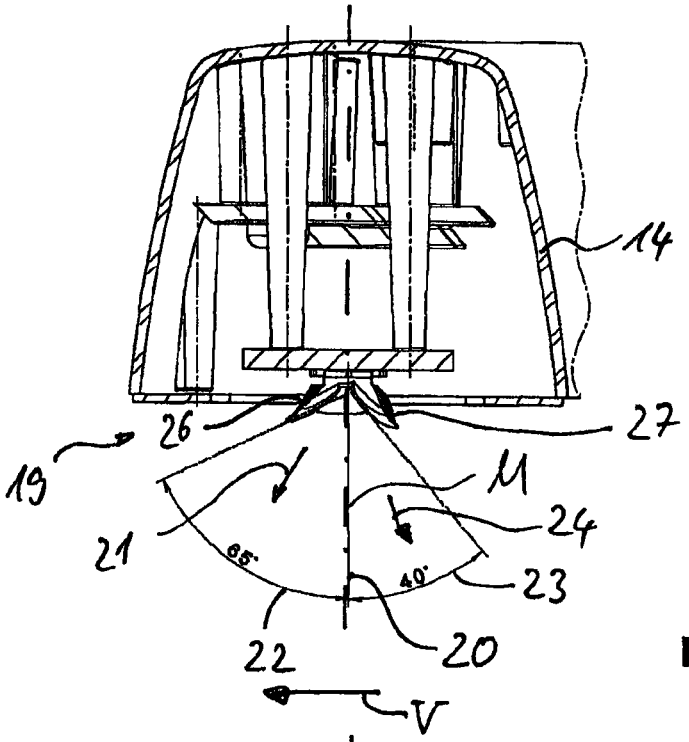
FIG. 6 is a sectional view of a lamp unit of the lighting module along line VI-VI in FIG. 2.
Figure 7:
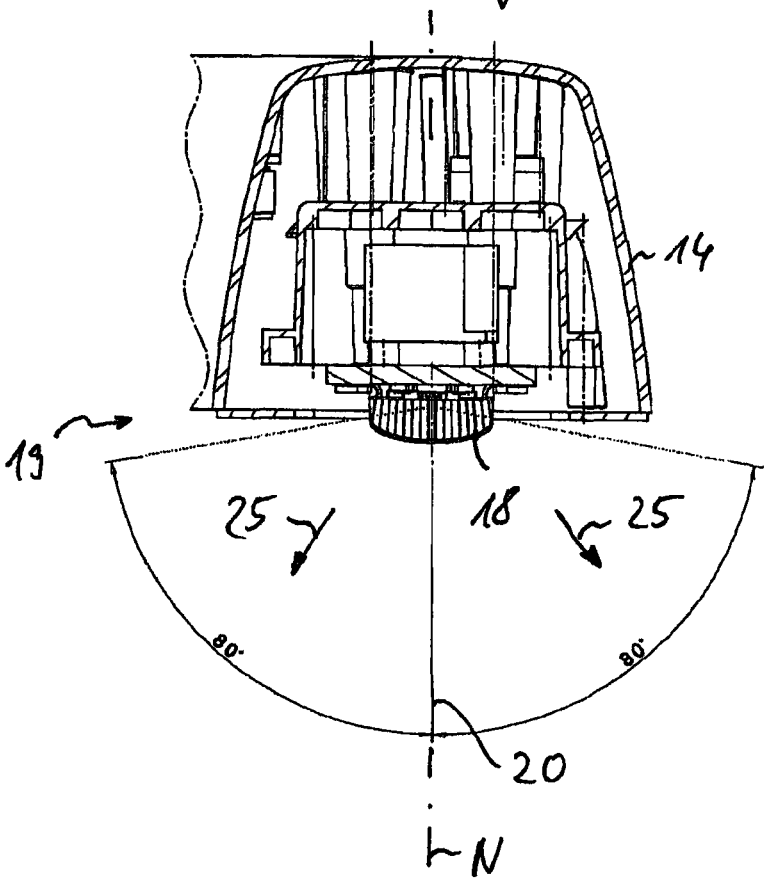
FIG. 7 is a sectional view of a lamp unit of the lighting module along line VII-VII in FIG. 2.

As can be seen in FIGS. 6 and 7, the lamp unit 19 emits a first partial light beam 21 in relation to a central plane M that intersects an optical axis 20, in a first dihedral range 22 which in relation to the central axis M is larger than a second dihedral range 23 in which a second partial light beam is emitted on a second side in an opposite location relative to the central axis M. This asymmetric light distribution characteristic is generated by the shape of lens 18, whereby the light emanating from the LED chip 16 is redirected through reflection and/or refraction, so that the first partial light beam 21 and the second partial light beam 24 produce an asymmetric light distribution characteristic relative to the central plane M. In the lamp unit 19 of the first type the central plane M extends in a transverse direction in relation to the longitudinal orientation of the support board 15.

As shown in FIG. 7, lens 18 is shaped in a way whereby, relative to a central plane N that is rotated by 90° relative to the central plane M, a partial light beam 25 is symmetrically emitted. In the lamp unit 19 of the first type the second central plane N extends in the longitudinal direction of the support board 15 and intersects the optical axis 20. The central plane M and the second central plane N both extend in a perpendicular direction relative to the support board 15.

As shown in FIG. 6, lens 18 features on one side a first flat wing 26 and a second steep wing 27. The relatively flat first wing 26 results in the emission of a relatively wide first partial light beam 21 in the first dihedral range 22 (65°). The relatively steep second wing 27 leads to the emission of the second partial light beam 24 in the second dihedral range 23 (40°). The first partial light beam 21 is thus emitted at a larger angle relative to the central plane M than the second partial light beam 24. The lamp unit 19 of the first type exhibits a preferred direction V toward a front face of support board 15 which is faced by the relatively flat wing 26 of lens 18. The first partial light beam 21 and the second partial light beam 24 form an asymmetrical section of the light distribution characteristic relative to the central plane M.

Figure 9A:
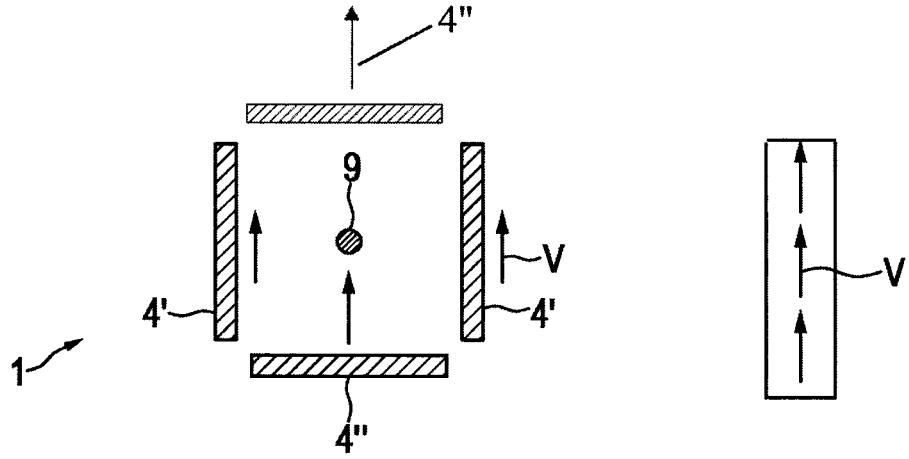
FIG. 9*a* is a schematic top view of the frame-shaped lighting device per FIGS. 1 to 3 in a first configuration in which the lighting modules point in the same preferred direction.
Figure 9B:
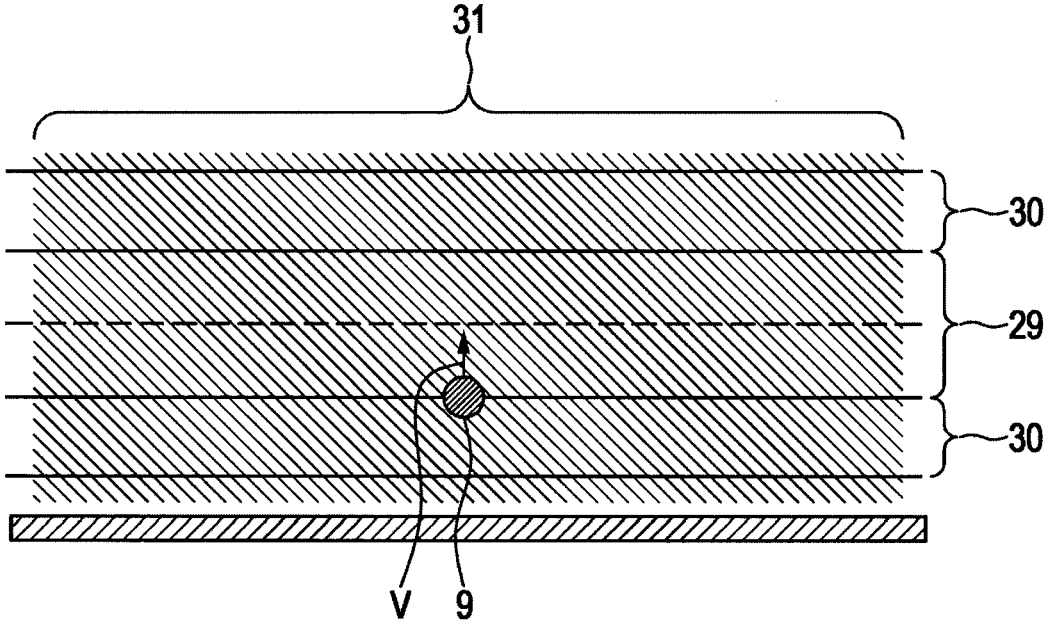
FIG. 9*b* is a schematic bird's eye view of a longitudinal street area, showing the position of the lighting device.
Figure 9C:
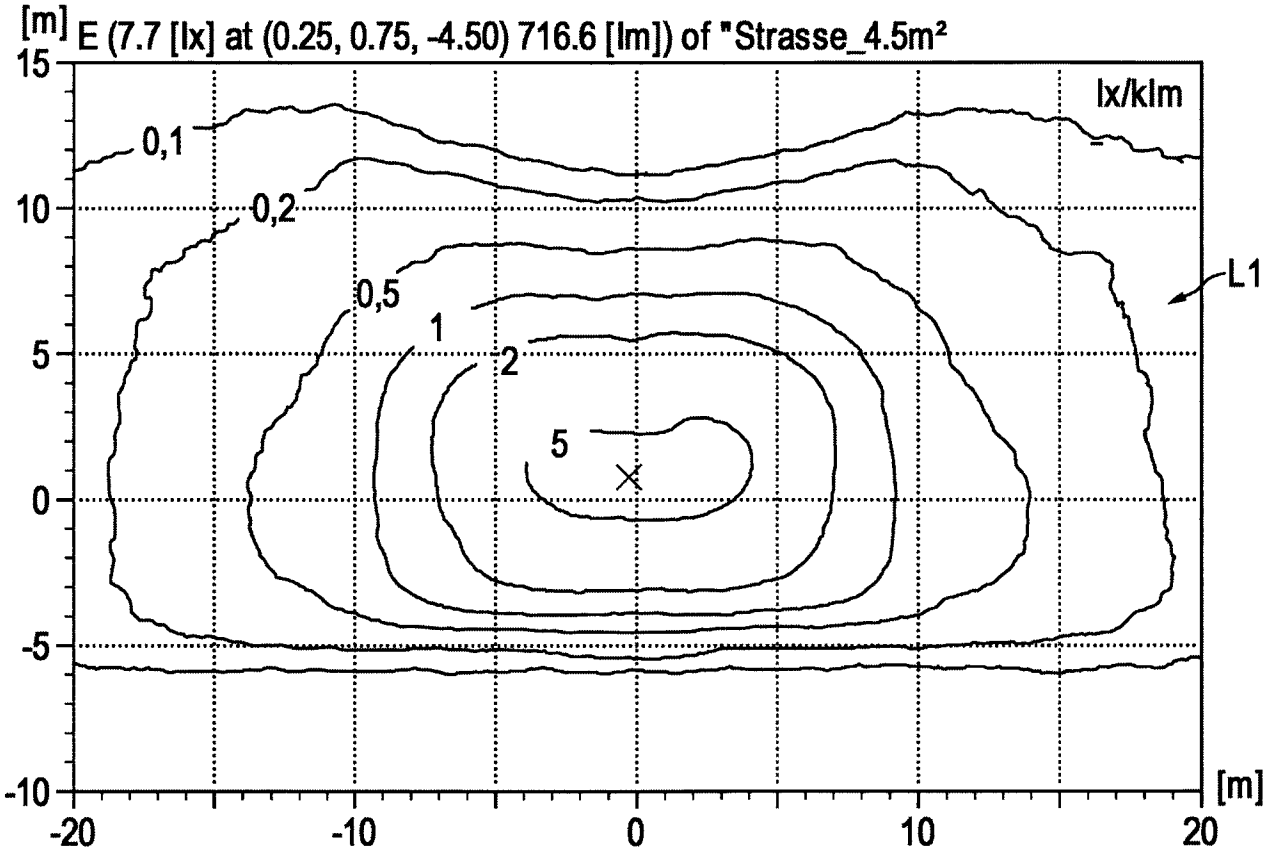
FIG. 9*c* shows an asymmetric light distribution of the lighting device per FIG. 9*a;*

A lamp unit 28 of a second type differs from lamp unit 19 of the first type in that lens 18 is positioned at a 90° angle relative to a reference axis of support board 15. The reference axis extends coaxially with the optical axis 20 of lamp unit 28. As shown in FIG. 2, the rows of lamp units 28 of the second type form lighting module 4" of the second type and the flat wings 26 of the corresponding lenses 18 point in the same preferred direction V as the flat wings 26 of lenses 18 of lamp unit 19 in lighting modules 4' of the first type. The result is a lighting device 1 with an asymmetric light distribution pattern (light distribution characteristic) serving to illuminate a street 29, the lighting device 1 in this case positioned in a transitional area between the street 29 and a bicycle path/sidewalk 30, as indicated in FIG. 9*a*, 9*b*. FIG. 9*b* shows the pole axis of lighting device 1, FIG. 9*c* illustrates the asymmetric and relatively homogeneous light distribution L1 of lighting device 1.

FIGS. 2 and 3 show that the optical axes 20 of lamp units 19 of the first type and of lamp units 28 of the second type extend parallel to each other. The support boards 15 of lighting modules 4, 4', 4" extend in a common plane perpendicular to the pole axis 9 and perpendicular to optical axis 20. Thus, lighting modules 4, 4', 4" essentially extend in a two-dimensional space, essentially parallel to a longitudinal area 31 of the street 29 that is illuminated by the light beam of lighting device 1.

It will be evident that the lamp units 19, 28 incorporate the same components, these being identical LED chips 16 and the same lenses 18. The only difference is that the lenses 18 are positioned at a 90° angle to the reference axis 20. In an alternative embodiment, not illustrated, other lighting modules may contain lamp units whose lens 18 is turned 180° relative to lens 18 of lighting module 4' of the first type. As another alternative, lighting modules 4, 4', 4" may only in part contain lamp units of the same type. For example, lamp units of different types may be used in a relative long lighting module.

In the exemplified embodiments here described, the lighting modules 4, 4', 4" each contain lamp units whose lenses 18 are in the same position relative to support board 15 of lighting module 4, 4', 4".

Figure 10A:
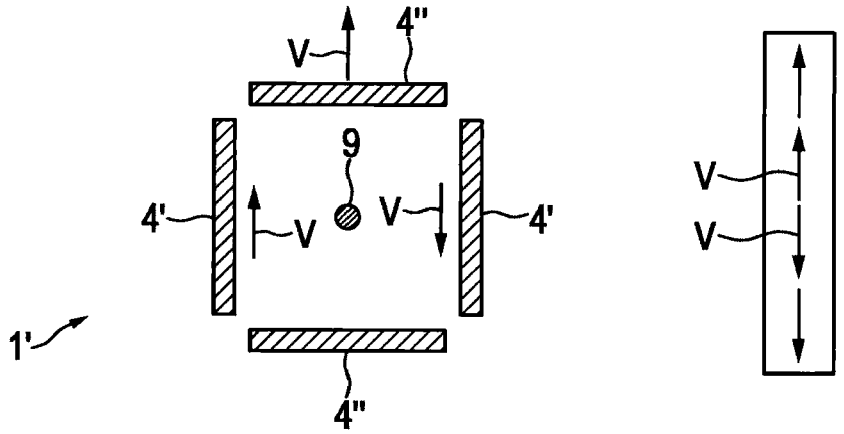
FIG. 10*a* is a schematic top view of the frame-shaped lighting device per FIGS. 1 to 3 in a first configuration, with each two lighting modules pointing in opposite preferred directions.
Figure 10B:
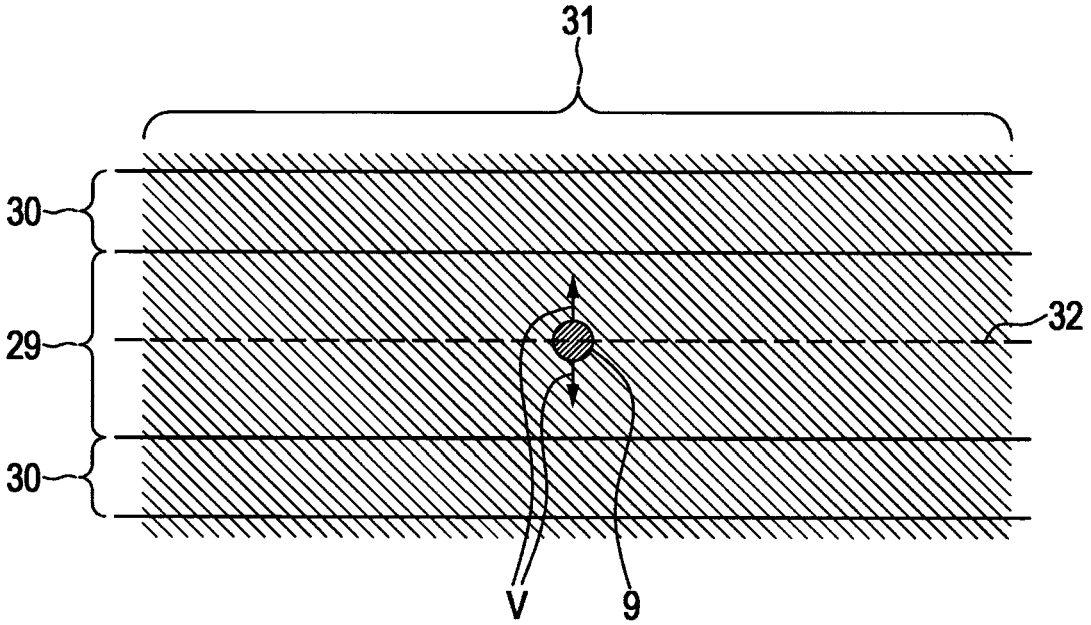
FIG. 10*b* is a schematic bird's eye view of a longitudinal street area, showing the position of the lighting device.
Figure 10C:
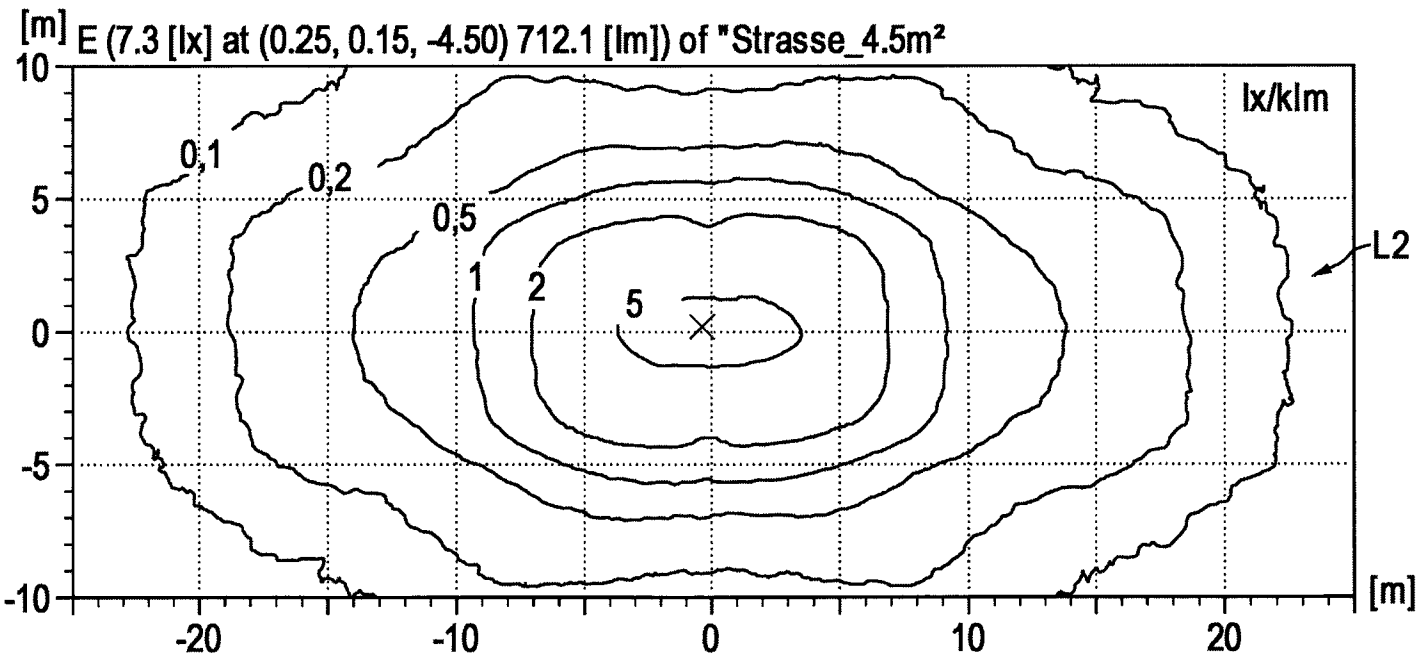
FIG. 10*c* shows a schematic light distribution of the lighting device per FIG. 10*a;*

In an alternative embodiment of a lighting device 1' per FIGS. 10*a* to 10*c*, the frame-shaped housing 2—as in lighting device 1—may be equipped with two lighting modules 4' of the first type and two lighting modules 4" of the second type in which case, however, the lighting modules 4' and, respectively, 4" positioned on opposite frame sides 5, point in opposite preferred directions and not—as in lighting device 1—in the same preferred direction V. As shown in FIG. 10*a*, while lighting modules 4', 4" mounted on opposite frame sides 5 are of the same type, they are turned 180° relative to pole axis 9, so that by superpositioning light beams with equally distributed preferred directions V are emitted in two opposite directions. This lighting device 1' would preferably be positioned above the median 32 of street 29, with the preferred directions V extending in a transverse relation to the median 32 for a homogeneous illumination of the longitudinal area 31 of street 29. FIG. 10*c* illustrates a light distribution L2 obtained with lighting device 1'.

Figure 11A:
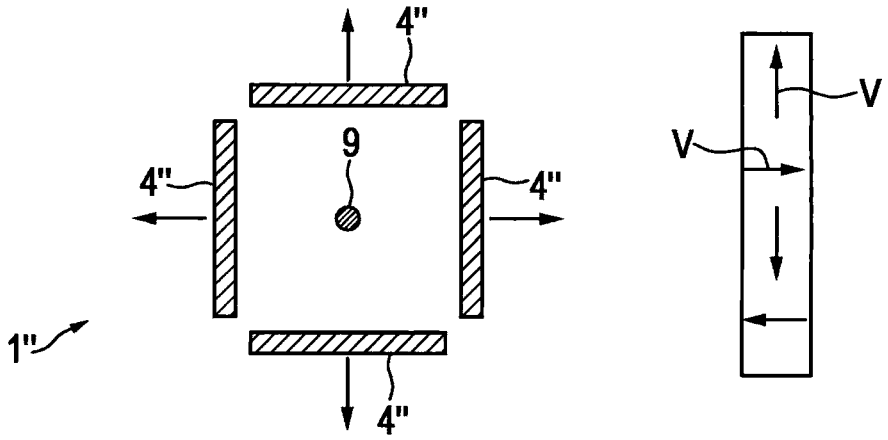
FIG. 11*a* is a schematic top view of the frame-shaped lighting device per FIGS. 1 to 3 in a second configuration, with each lighting module pointing in a different preferred outward direction.
Figure 11B:
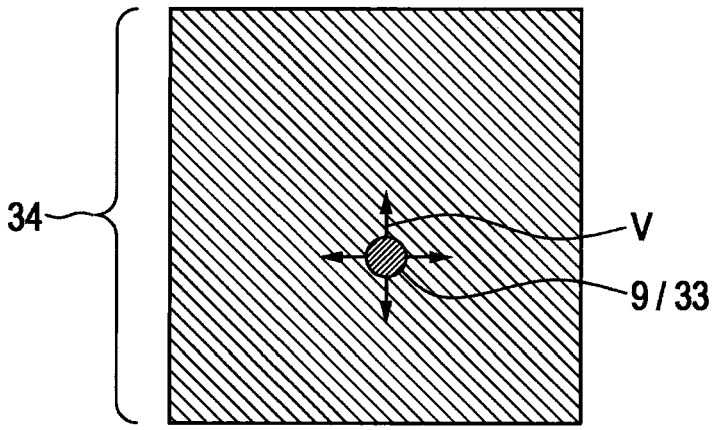
FIG. 11*b* is a schematic bird's eye view of a longitudinal street area, showing the position of the lighting device.
Figure 11C:
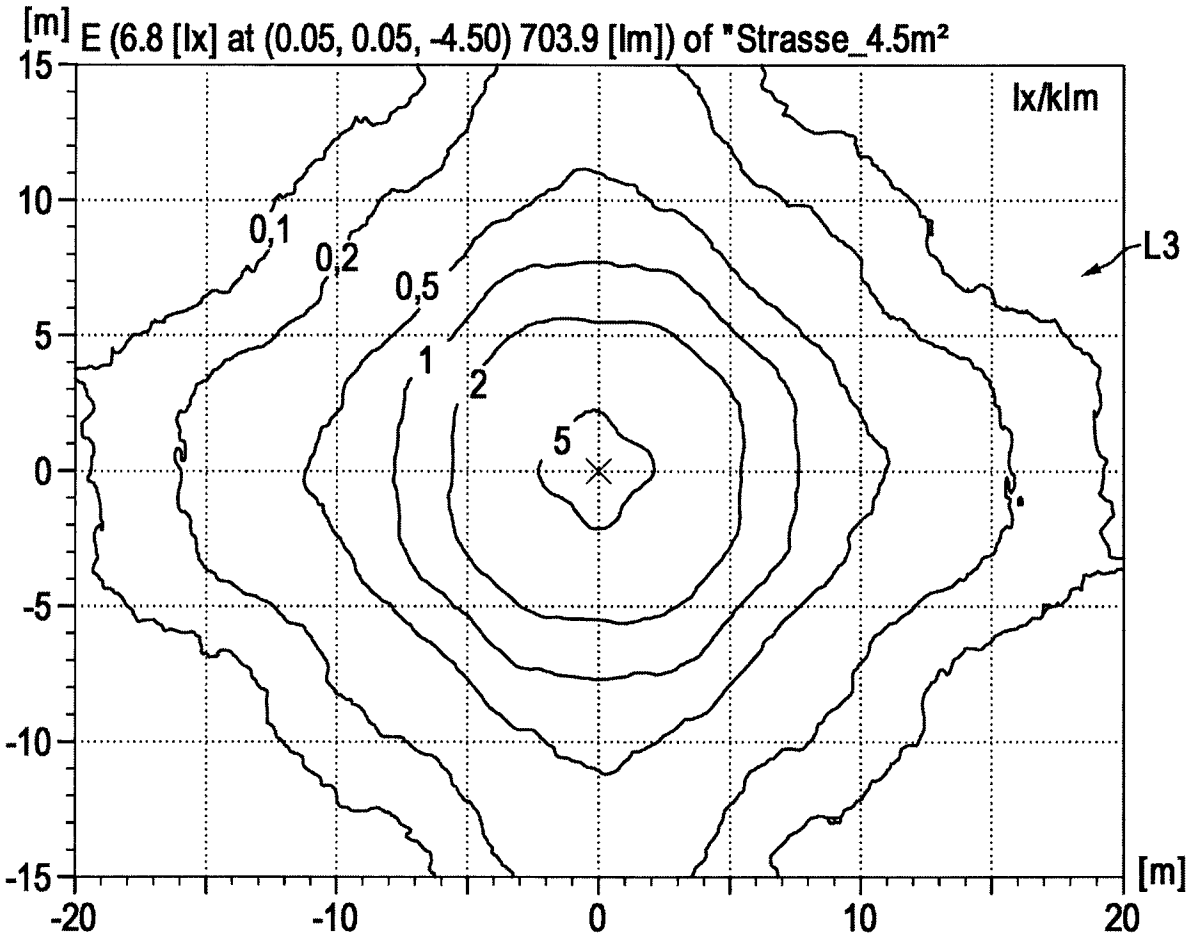
FIG. 11*c* shows a rotationally symmetric light distribution of the lighting device per FIG. 11*a;*

In another embodiment of a lighting device 1" per FIG. 11*a* to 11*c*, the frame-shaped housing 2, unlike that in lighting device 1, may be equipped with lighting modules 4" of the second type. These lighting modules 4" will be positioned in a way whereby their preferred directions V point outward away from the pole axis 9, so that lighting device 1", preferably located at a central point 33 of a place 34, can serve to homogeneously illuminate the latter as a function of the light distribution L3. The preferred direction V differs for each of the lighting modules 4". Advantageously this permits a rotationally symmetric illumination of a place 34.

Figure 12A:
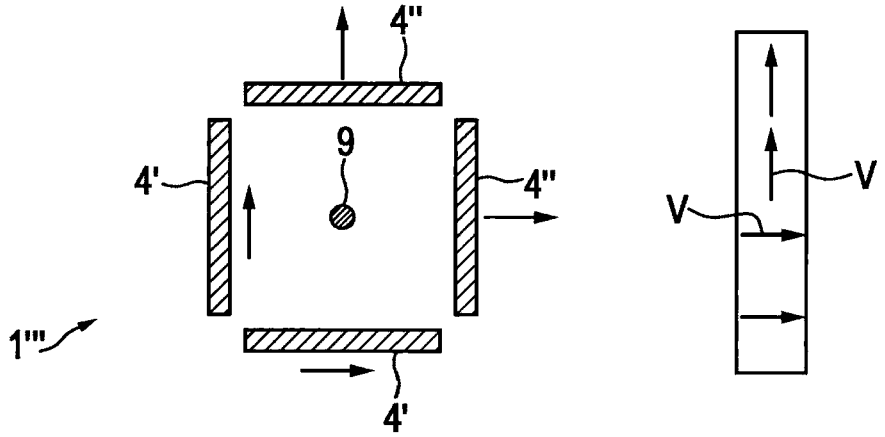
FIG. 12*a* is a schematic top view of the frame-shaped lighting device per FIGS. 1 to 3 in its first configuration, with each two lighting modules pointing in a preferred direction extending at a 90° angle from the other two lighting modules.
Figure 12B:
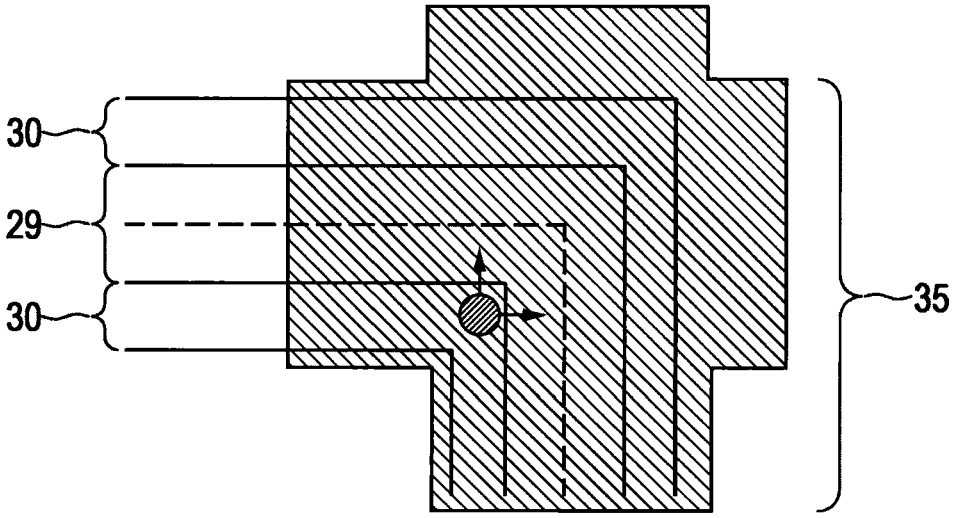
FIG. 12*b* is a schematic bird's eye view of a longitudinal street area, showing the position of the lighting device.
Figure 12C:
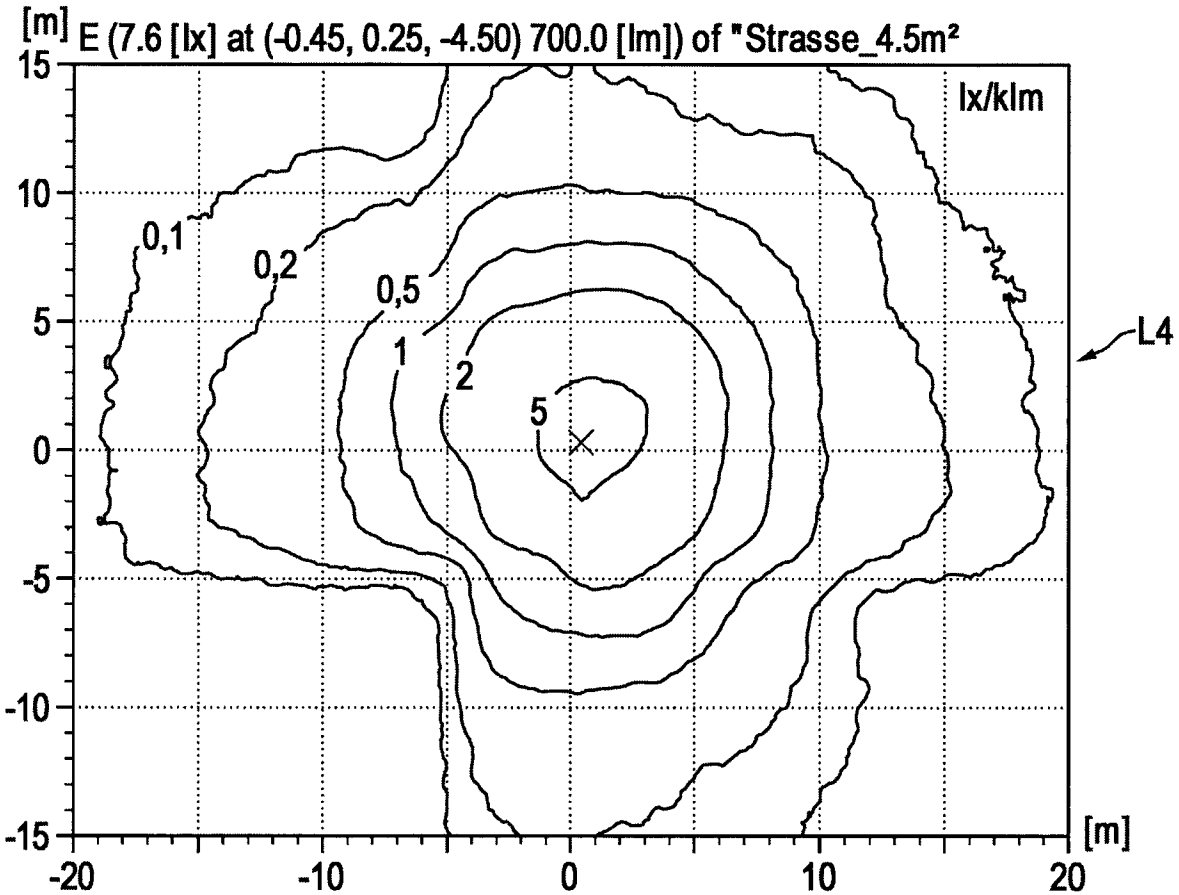
FIG. 12*c* shows an angular light distribution of the lighting device per FIG. 12*a.*

In another embodiment of a lighting device 1' as shown in FIGS. 12*a* to 12*c*, two lighting modules 4' of the first type and two lighting modules 4" of the second type may be employed, in which case there will only be two preferred directions V which in relation to the pole axis 9 are positioned at a 90° angle relative to each other. Advantageously this permits homogeneous illumination of a road junction or of the corner 35 of a street 29 as a function of the light distribution L4 as shown in FIG. 12*c*.

Figure 8A:
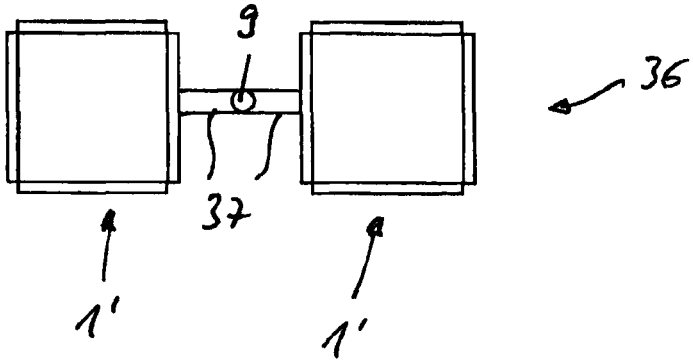
FIG. 8*a* is a schematic top view of a dual-frame-shaped lighting device.

In another embodiment according to FIG. 8*a*, two frame-shaped lighting devices 1' may be combined to form a dual-frame lighting device 36. The two frame-shaped lighting devices 1' are positioned on two sides of pole axis 9 and may be attached to the pole by means of holding devices 37. This lighting device 36 is preferably used for relatively wide streets, especially multi-lane streets, with the lighting device 36 positioned above the median 32.

Figure 8B:
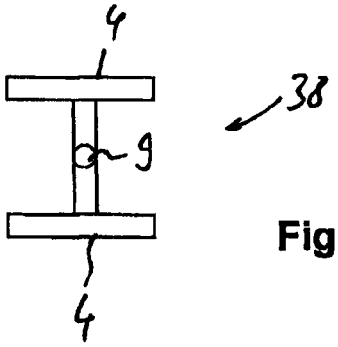
FIG. 8*b* is a schematic top view of a dual-line-shaped lighting device.

In another embodiment per FIG. 8*b*, a dual linear lighting device 38 may be provided, in which case two lighting modules 4 will be mounted on both sides of pole axis 9, extending parallel to each other.

Figure 8C:
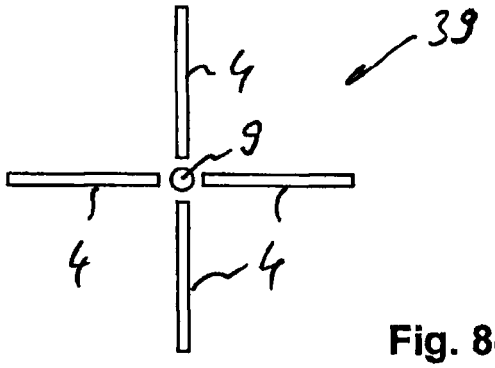
FIG. 8*c* is a schematic top view of a crossform lighting device.
Figure 8D:
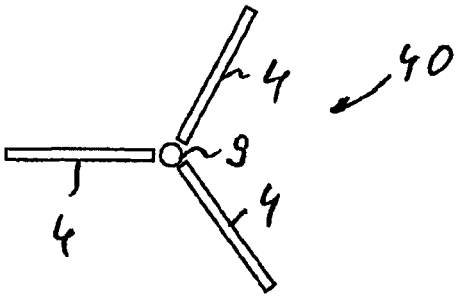
FIG. 8*d* is a schematic top view of a propeller-shaped lighting device.

In another embodiment as shown in FIG. 8*c*, four lighting modules 4 may be installed in a cross like form arrangement at a 90° angle from one another so as to form a cross-shaped lighting device 39.

Alternatively, a propeller-shaped lighting device 40 can be created by positioning three lighting modules 4 around the pole axis at a 120° angle.

Figure 8E:
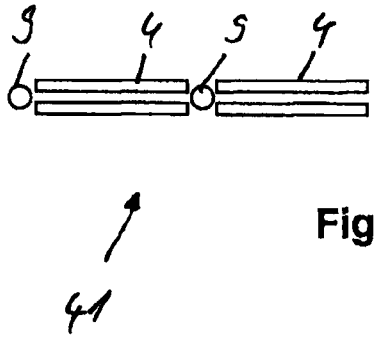
FIG. 8*e* is a schematic top view of a linear lighting device in a first embodiment.
Figure 8F:
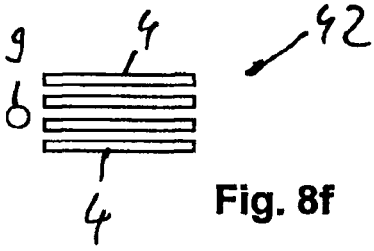
FIG. 8*f* is a schematic top view of a linear lighting device in a second embodiment.

In another embodiment as shown in FIG. 8*e*, a linear lighting device 41 may be provided by sequentially positioning multiple lighting modules 4 in a longitudinal direction.

In another embodiment of a linear lighting device 42, the lighting modules 4 may merely by be positioned in the form of a parallel flush-mounted array.

The modular concept permits a simple adaptation to given lighting requirements. In particular, with only two different lighting modules 4', 4" it is possible to create various configurations of lighting devices.

The lighting device can be employed not only for street lighting but also for illuminating industrial facilities or living rooms. For example, the lighting device according to the invention can be used for illuminating moisture- and explosion-proof rooms, in a kitchen area, on furniture and the like.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

It will be appreciated to those skilled in the art having the benefit of this disclosure that this invention is believed to provide lighting devices. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

| | |
|---|---|
| 1, 1', 1", 1"' | lighting device |
| 2 | frame-shaped housing |
| 3 | base |
| 4, 4', 4" | lighting modules |
| 5 | frame side |
| 6 | opening |
| 7 | |
| 8 | brackets |
| 9 | axis of symmetry |
| 10 | bottom side |

-continued

LIST OF REFERENCE NUMERALS

| | |
|---|---|
| 11 | recesses |
| 12 | cover plate |
| 13 | rim of opening |
| 14 | lower casing |
| 15 | support board |
| 16 | LED chips |
| 17 | main emission direction |
| 18 | lens |
| 19 | lamp unit |
| 20 | optical axis |
| 21 | first partial light beam |
| 22 | first dihedral range |
| 23 | second dihedral range |
| 24 | second partial light beam |
| 25 | light beam |
| 26 | first flat wing |
| 27 | second steep wing |
| 28 | lamp unit |
| 29 | street |
| 30 | bicycle path/sidewalk |
| 31 | longitudinal street area |
| 32 | median |
| 33 | central point |
| 34 | place |
| 35 | corner |
| 36 | lighting device |
| 37 | holding devices |
| 38 | lighting device |
| 39 | lighting device |
| 40 | lighting device |
| 41 | lighting device |
| 42 | lighting device |
| 43 | |
| 44 | |
| 45 | |
| 46 | |
| 47 | |
| 48 | |
| L1 | light distribution |
| L2 | light distribution |
| L3 | light distribution |
| L4 | light distribution |
| M | central plane |
| N | central plane |
| V | preferred direction |

What is claimed is:

1. A lighting device for illumination of a surface area of streets and pathways, comprising:

a housing positionable at a distance from a surface area to be illuminated, and multiple lighting modules arranged on a support board in said housing, wherein the multiple lighting modules include first and second lighting modules, wherein each of the first lighting modules contains first lamp units that comprise first light sources and first lenses each having an elongated shape and mounted in front of a corresponding first light source with an elongation of said shape extending in a direction defined by a corresponding first lighting module;

wherein each of the second lighting modules contains second lamp units that comprise second light sources and second lenses each having an elongated shape and mounted in front of a corresponding second light source with an elongation of said shape extending in a direction defined by a corresponding second lighting module which is perpendicular to the direction of the elongated shape of the first lenses in at least one of said first lighting modules;

wherein first lenses are the same as second lenses, wherein the first and second lighting modules are disposed at a periphery of the housing to define respectively corresponding first and second light distributions;

wherein said first and second lamp units have respectively corresponding first and second optical axes that are substantially parallel to one another, wherein at least one of said first and second lamp units is configured to generate light distribution that is asymmetric relative to a central plane of the at least one of said first and second lamp units, wherein at least one of first and second lenses has a first substantially flat wing and a second steep wing, and wherein said first substantially flat wing is shaped to form a first beam in a first sector of the asymmetric light distribution, and the second steep wing is shaped to form a second beam in a second sector of the asymmetric light distribution, the first substantially flat wing and the second steep wing aggregately defining an elongated concave emitting surface through which light passing through the at least one of the first and second lenses from a corresponding lamp unit is emitted from the at least one of the first and second lenses.

2. A lighting device according to claim 1, wherein at least one of the first and second lenses are asymmetric whereby on a first side of the central plane intersecting an optical axis the light refracted by a lens is emitted, from at least one of the first and second lenses, as a first partial light beam in a first angle range, while on a second side of the same central plane said light is emitted as a second partial light beam in a second angle range, the first and second angle ranges being different from each other, the first and second partial light beams defining an asymmetric spatial light distribution.

3. A lighting device according to claim 2, wherein the first partial light beam emitted in the first angle range defines a preferred direction of the asymmetric light distribution of at least one of a respectively corresponding lamp unit and a respectively corresponding lighting module, the first angle range being larger than the second angle range.

4. A lighting device according to claim 1, wherein at least one of the first and second lamp units is provided with lenses mounted in the same relative orientation in relation to the support board of a respectively corresponding lighting module.

5. A lighting device according to claim 1, wherein lenses of at least one of said multiple lighting modules are mounted in one of (i) a common first relative orientation in relation to a support board of the at least one of said multiple lighting modules, and (ii) a common second relative orientation defined by a rotation-by 90° or 180° about a reference axis in relation to the first relative orientation.

6. A lighting device according to claim 1, further comprising a pole of the device and wherein the multiple lighting modules are arranged in a square formation and each extends in a direction that is either perpendicular to the pole or parallel to the surface area.

7. A lighting device according to claim 6, wherein two or more of said multiple lighting modules are provided with corresponding lenses each of which has the same orientation with respect to the support board, and wherein two or more of said lighting modules are oriented such that, when positioned on the pole for illuminating a street, create light outputs that share the same preferred direction.

8. A lighting device according to claim 1, wherein the lighting device has four lighting modules, each lighting module provided with corresponding lenses each of which has the same orientation with respect to the support board, and wherein the four lighting modules and the corresponding lenses are arranged in a manner whereby, when the lighting device is positioned to illuminate a corner area, modules from said four lighting modules extend in two directions at a 90° angle relative to each other.

9. A lighting device according to claim 1, wherein at least one of the first and second lamp units includes an LED light source, and wherein the support board on which the LED light source and a corresponding lens are mounted is sealed off by a transparent cover plate.

10. A lighting device according to claim 1, wherein the first and second light distributions are different from each other.

* * * * *